US005975684A

United States Patent [19]

Suetsugu et al.

[11] Patent Number: 5,975,684

[45] Date of Patent: Nov. 2, 1999

[54] INK JET RECORDING HEAD HAVING AN INK STREAM PATH

[75] Inventors: Junichi Suetsugu; Kazuo Shima; Ryosuke Uematsu; Hitoshi Minemoto; Yoshihiro Hagiwara, all of Tokyo, Japan

[73] Assignee: NEC Corporation, Japan

[21] Appl. No.: 08/738,547

[22] Filed: Oct. 28, 1996

[30] Foreign Application Priority Data

Oct. 30, 1995 [JP] Japan ..... 7-281821

[51] Int. Cl.[6] ..... B41J 2/06

[52] U.S. Cl. ..... 347/55

[58] Field of Search ..... 347/55, 112, 141, 347/151, 89

[56] References Cited

U.S. PATENT DOCUMENTS

| | | | |
|---|---|---|---|
| 4,011,157 | 1/1977 | Pennebaker, Jr. et al. | 347/89 X |
| 4,117,778 | 10/1978 | Watanabe et al. | 347/89 X |
| 5,561,448 | 10/1996 | Kaneko et al. | 347/89 X |

FOREIGN PATENT DOCUMENTS

| | | | |
|---|---|---|---|
| 0267782A2 | 5/1988 | European Pat. Off. . | |
| 0703080A2 | 3/1996 | European Pat. Off. . | |
| 0703081A2 | 3/1996 | European Pat. Off. . | |
| 61-57343 | 3/1986 | Japan | 347/55 |
| 5-254118 | 10/1993 | Japan . | |
| 2031344 | 4/1980 | United Kingdom | 347/55 |
| 93/11866 | 6/1993 | WIPO . | |
| 95/32864 | 12/1995 | WIPO . | |

OTHER PUBLICATIONS

Patent Abstracts of Japan, Jun. 20, 1990, JP–A–2–160557 (Minolta Camera Co. Ltd).

Patent Abstracts of Japan, Jul. 11, 1990, JP–A–2–178055(Minolta Camera Co Ltd).

*Primary Examiner*—John Barlow

*Assistant Examiner*—C. Dickens

*Attorney, Agent, or Firm*—Ostrolenk, Faber, Gerb & Soffen, LLP

[57] ABSTRACT

In a small-sized, simple ink jet recording head achieves a high-quality and stable printing operation. The head includes an ejection cell for keeping therein ink including toner particles, a slit-shaped ink ejection slot disposed in a portion of the ejection cell, a electrophoresis electrode for concentrating the toner particles onto the ink ejection slot, an ejection electrode disposed in the ink ejection slot for imparting ejection force to the toner particles, and an ink stream path disposed in the ejection cell along a side wall of the ejection cell. The ink ejection slot is disposed in a portion of the side wall constituting the ink stream path.

7 Claims, 4 Drawing Sheets

INK JET RECORDING HEAD HAVING AN INK STREAM PATH

BACKGROUND OF THE INVENTION

The present invention relates to an ink jet recording head, and in particular, to an ink jet recording head for ejecting toner particles of liquid ink onto a recording media by electrostatic force and thereby achieving a recording operation.

FIG. 1 shows a conventional example of an ink jet recording head, which has been described in the Japanese Patent Laid-Open Publication No. 5-254118.

The ink jet head of FIG. 1 includes a plurality of nozzles 55*a* for ejecting ink therefrom, an ink stream path 54*a* connected to the nozzles 55*a,* a pressure generating element 56 for generating an ink ejecting pressure in the ink path 54*a,* and voltage applying means 58 for applying a voltage to the pressure generating element 56. Employed as the recording ink is pigment dispersion ink. In addition, there are disposed in the ink path 54*a* a plurality of segment electrodes 53 for mixing the pigment in the ink to obtain a uniform density thereof. Each segment electrode 53 is linked with a driver circuit 51 including potential difference generating means.

When a driving voltage pulse is applied to the segment electrodes 53 to alternately generate a potential difference therebetween, micro-particles of solid pigment having a negative charge are electrically moved by electrophoresis to prevent precipitation and coagulation of pigment particles.

FIG. 2 shows another conventional example of the ink jet recording apparatus described in the Japanese Patent Laid-Open Publication No. 61-57343.

The recording apparatus shown in FIG. 2 includes an ink chamber 68 to be filled with insulating ink, a porous member 69 arranged in the ink chamber 68, pump means (not shown) to flow ink into the porous member 69, a nozzle 70 coupled with the ink chamber 68, a signal electrode 61 disposed in the nozzle 70, and a rear electrode 62 provided to oppose to the signal electrode 64 with a recording media 64 arranged therebetween. In this structure, when a signal voltage is applied to the signal electrode 61, there is produced an electric field between the signal electrode 61 and the rear electrode 62 such that ink particles are ejected from a tip end of the nozzle 70 onto the recording media 64, thereby achieving a recording operation. In the system, the liquid ink flows through the porous member 69 by a pressure generated by the pump means, not shown, and is thereby electrically charged.

However, the conventional example described in the Japanese Patent Laid-Open Publication No. 5-254118 requires a plurality of pressure generating elements made of a piezoelectric substance to jet or eject the pigment ink and hence is attended with a disadvantage that the size of the ink jet recording head is increased. Additionally, there is employed a method in which the ink is ejected according to displacement of the piezo-electric material, namely, the pigment is not emitted by use of the electric field. Consequently, the precision of the ink ejecting direction considerably depends on the contour of nozzles and the like. Moreover, since it is necessary to fabricate a fine nozzle hole for each recording dot, the improvement of recording resolution is limited.

In addition, in the prior art example described in the Japanese Patent Laid-Open Publication No. 61-57343, due to the porous member disposed in the ink chamber to electrically charge the ink particles, there exist disadvantages that the recording head is increased in size, the head manufacturing job becomes difficult, and a high-power pump is necessary to supply ink to the nozzle through the porous member developing a high resistance against the ink stream.

SUMMARY OF THE INVENTION

It is therefore an object of the present invention to provide an ink jet recording head configured particularly in a compact and simple structure to achieve a stable printing operation with a high printout quality, thereby solving the disadvantages of the conventional examples.

In accordance with a first aspect of the present invention, to achieve the object above, there is provided an ink jet recording head including an ejection cell for keeping therein ink including toner particles, a slit-shaped ink ejection slot disposed in a portion of the ejection cell, a electrophoresis electrode for concentrating the toner particles onto the ink ejection slot, an ejection electrode disposed in the ink ejection slot for imparting ejection force to the toner particles, and an ink stream path disposed in the ejection cell along a side wall of the injection cell. The ink ejection slot is disposed in a portion of the side wall constituting the ink stream path.

Consequently, in accordance with the present invention, the toner particles conveyed together with the ink stream up to the ink ejection slot are concentrated onto the ink ejection slot under the influence of the electric field generated between the electrophoresis electrode and the oposing electrode. Additionally, counter ions appearing after the toner particles are thus ejected are moved by electrophoresis onto the side of the electrophoresis electrode and are transported by the ink flow to be resultantly removed from the ink ejection slot.

In accordance with a second aspect of the present invention, there is provided an ink jet recording head in which the electrophoresis electrode is disposed in a zone ranging from an upstream side of the ink stream path to the ink ejection slot, the electrode being disposed along the ink stream.

Therefore, in accordance with the present invention, while the toner particles contained in the ink are being conveyed up to the ink ejection slot, the toner particles are gradually collected to the side on which the ink ejection slot is disposed.

In accordance with a third aspect of the present invention, there is provided an ink jet recording head in which the electrophoresis electrode is disposed in a zone ranging from an upstream side of the ink stream path to the ink ejection slot, the electrode being disposed along the ink stream. Moreover, the ejection electrode is coated with an insulating film.

In consequence, in accordance with the present invention, the counter ions appearing after the ejection of toner particles are attracted to the side of the electrophoresis electrode to be brought into contact therewith so as to be discharged and removed. On the other hand, the toner particles concentrated in the areas of the ejection electrodes are not electrically brought into contact with the ejection electrodes.

In accordance with a fourth aspect of the present invention, there is provided an ink jet recording head in which the electrophoresis electrode is disposed in a zone ranging from an upstream side to a downstream side of the ink ejection slot.

Consequently, in accordance with the present invention, the electric field is formed between the electrophoresis electrode and the ejection electrodes not only on the upstream side but also on the downstream side. In addition, the counter ions are moved by electrophoresis also in the process of flowing out the ink.

In accordance with a fifth aspect of the present invention, there is provided an ink jet recording head further including a plurality of slit forming members for subdividing the ink ejection slot into slit-shaped partitions, the members including wires.

Therefore, in accordance with the present invention, a plurality of ink meniscus are configured at the single ink ejection slot.

In accordance with a sixth aspect of the present invention, there is provided an ink jet recording head in which the ink stream path includes a bent portion in the vicinity of the ink ejection slot.

Consequently, in accordance the present invention, the speed of the ink stream is particularly lower in a central portion of the ink stream than in the vicinity of the ink ejection slot.

Thanks to the aspects above, the object will be achieved in accordance the present invention.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
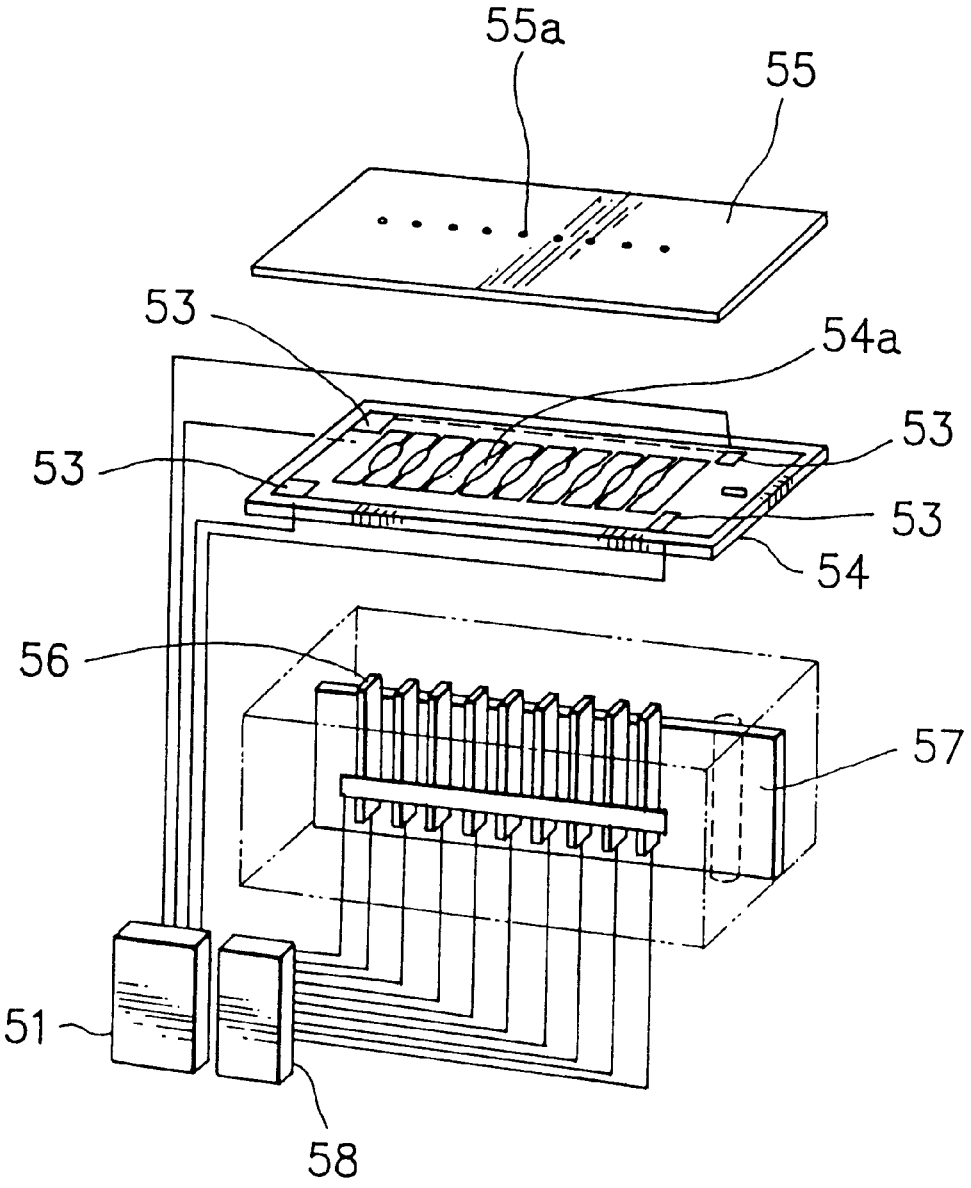
FIG. 1 PRIOR ART
FIG. 1 is a partly omitted, exploded perspective view showing a conventional example of an ink jet head.
Figure 2:
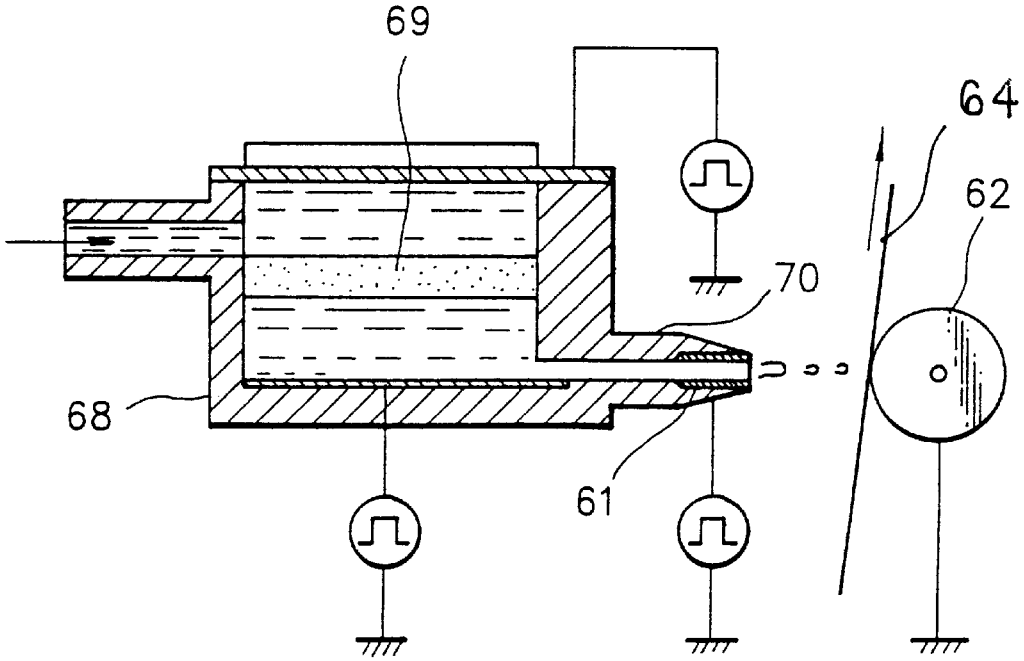
FIG. 2 PRIOR ART
FIG. 2 is a cross-sectional view showing another conventional example of an ink jet head.
Figure 3A:
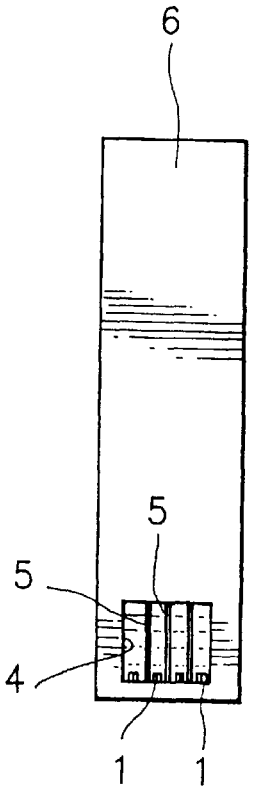
FIG. 3A is a front view of an embodiment of an ink jet head in accordance with the present invention.
Figure 3B:
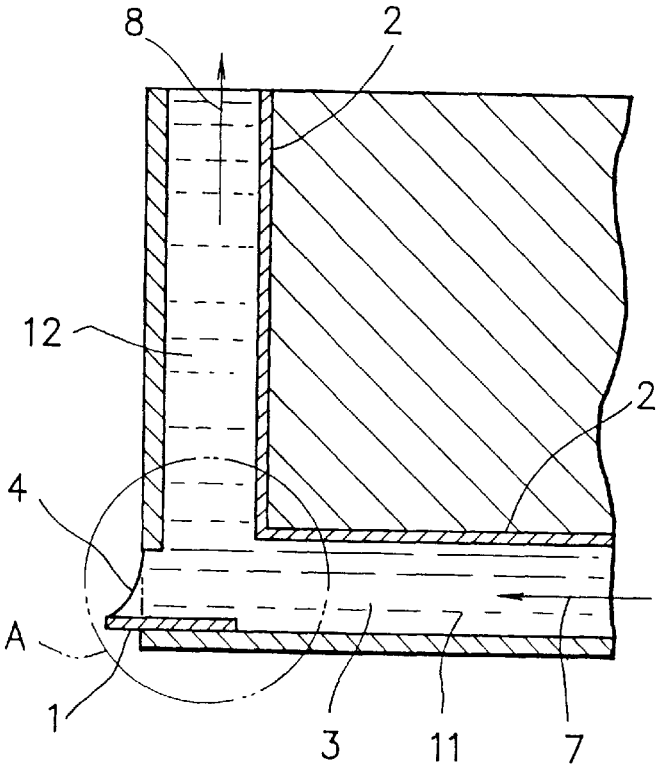
FIG. 3B is a cross-sectional view of the embodiment of FIG. 3A.
Figure 4:
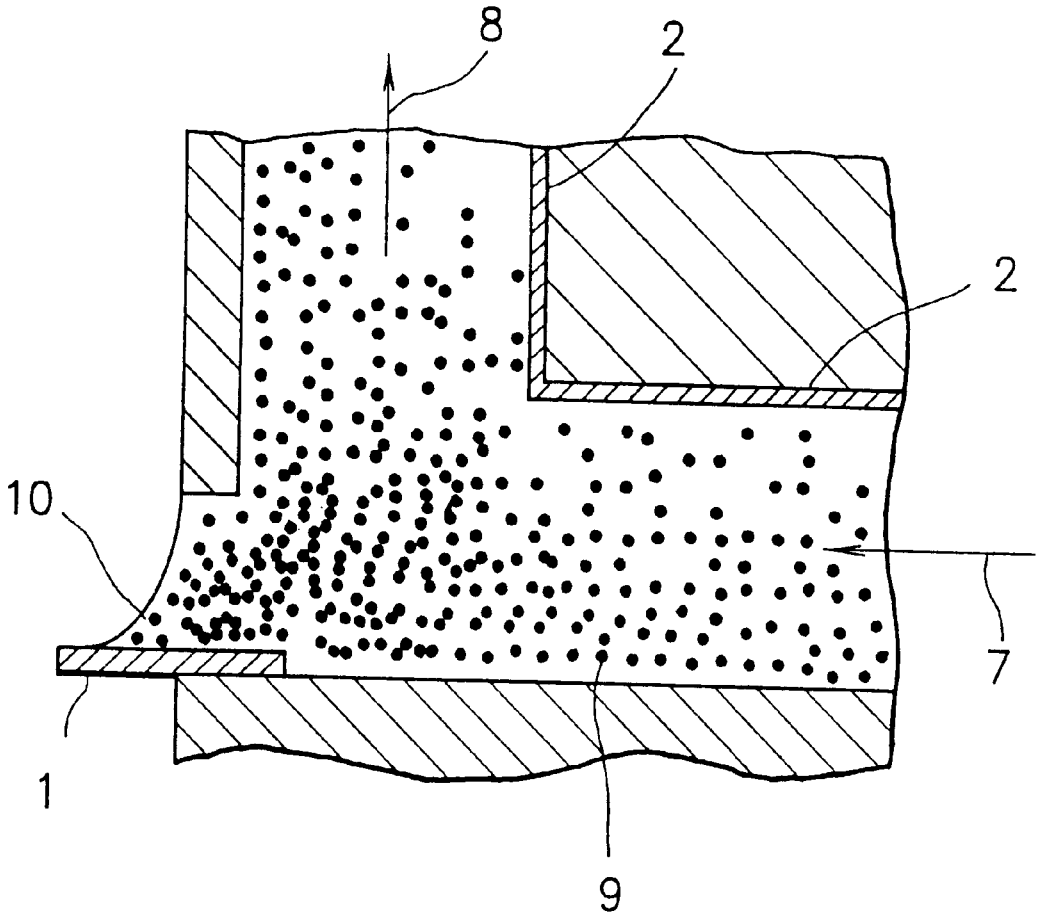
FIG. 4 is a magnified view of portion A of FIG. 3B.

Referring now to FIGS. 3A, 3B, and 4, description will be given of an embodiment of the ink jet recording head in accordance with the present invention.

The ink jet head shown in FIGS. 3A and 3B includes an ink ejection cell body 6 for keeping therein ink 3 including toner particles 9, a slit-shaped ink ejection slot 4 arranged in a portion of the ink ejection cell 6, a electrophoresis electrode 2 for concentrating the toner particles onto the ink ejection slot 4, and an ink ejection electrode 1 disposed in the ink ejection slot 4 for jetting the toner particles 9. Disposed in the ink ejecting cell 6 are an ink supply path 11 and an ink discharge path 12 as ink stream paths along a side wall of the ejection cell 6. The ink ejection slot 4 is arranged in a portion of the side wall configuring the ink stream paths 11 and 12.

More specifically, in accordance with the embodiment, the ejection electrode 1 is configured in a needle-like shape having a tip end which is slightly extended from the ejection cell 6. A plurality of such ejection electrodes 1 are disposed in parallel on a bottom surface of the ink ejection slot 4. The electrode 1 includes, for example, an inner lead wire on a tape carrier for the tape automated bonding (TAB), the inner lead wire being coated with an insulating film fabricated by coating an insulating material thereon. These electrodes are disposed with a pitch of 300 dots per inch (dpi), namely, at an interval of about 85 micrometers ($\mu$m). Moreover, the ejection electrode 1 is connected to ejection voltage control means, not shown, for applying thereto a high-voltage pulse with a polarity equal to that of the toner particles at timing according to a recording signal.

On the other hand, the electrophoresis electrode 2 is disposed on the upstream and downstream sides of the ink ejection slot 4 to be brought into contact with the ink 3 along an inner side of the ink paths 11 and 12. It is assumed that the ink flow is in the direction of arrow 7 in ink path 11 and in the direction of arrow 8 in ink path 12. In the configuration, the electrophoresis electrode 2 need only be provided at least in a zone ranging from the upstream side of the ink supply path 11 to the ink ejection slot 4 and along the ink supply path 11. Furthermore, the electrophoresis electrode 2 is connected to an electrophoresis voltage source, not shown, for applying a bias voltage having a polarity identical to that of the toner particles.

The ink 3 includes an organic solvent (iso-paraffin) produced from petroleum in which a charge control agent and fine particles of colored thermoplastic resin, so-called toner particles 9 are dispersed. The toners 9 are virtually charged to a positive polarity using zeta potential.

The ejection cell 6 is configured with a dielectric material in a parallelepiped or cuboid. In the cell 6, there is disposed the rectangular ink ejection slot 4 in a lower portion of the front view shown in FIG. 3A.

The ink ejection slot 4 includes a plurality of slot forming members 5 to subdivide the slot 4 into slit-shaped partitions or sections. Each member 5 includes a wire such as a fishing line made of silken gut. The members 5 are disposed on the side of the ejection cell 6 to separate the adjacent respective ejection electrodes 1 from each other, the members substantially facing an outer surface of the side wall of the ejection cell 6. The wire has a diameter of about 30 micrometers.

The ink stream paths 11 and 12 include a bent portion in the proximity of the ink ejection slot 4. Moreover, the paths 11 and 12 are connected via a tube to an ink tank, not shown, such that a negative pressure of about one $cmH_2O$ is applies to the ink 3 in the paths 11 and 12 and the ink 3 is forcibly circulated. To prevent leakage of the ink 3 from the ink ejection slot 4, the ink circulation is accomplished by sucking the ink 3 into the ink flow-out or discharge side.

On an extended position of the ejection electrode 1, there is disposed an opposing electrode, not shown, grounded via a recording media.

Referring next to FIG. 4, description will be given of operation of the jet ink head according to the embodiment.

When the system is set to an operative state, the negative pressure is applied to the ink 3 in the ink stream paths 11 and 12 and the ink 3 is forcibly circulated in a direction denoted by arrow 7 and 8 in FIG. 4. In this situation, the ink 3 forms an ink meniscus 10 in the portion at the ink ejection slot 4 due to its surface tension. Since the negative pressure is applied to the ink 3 and the ejection electrodes 1 are protruded relative to the ink ejection slot 4, the ink meniscus 10 is formed in the shape of a concave inclined as shown in FIG. 4 viewed from a side of the system. Additionally, the slit forming members 5 are disposed at positions between the respective ejection electrodes 1 in the ink ejection slot 4. Consequently, when viewed from the front side, the ink meniscus 10 has a contour in which the surface enclosed with the slit forming members 5 forms a bottom surface thereof and the tip ends of the ejection electrodes 1 configure a vertex thereof.

When a voltage is applied from the electrophoresis voltage source to the electrophoresis electrode 2, there is generated an electric field between the electrode 2 and the oposing electrodes not shown such that the toner particles 9 in the neighborhood of the ink ejection slot 4 are concentrated onto the area of the ink meniscus 10. Subsequently, when a high-voltage pulse is applied from the ejection voltage control means to an arbitrary ejection electrode 1, there is produced an electric field between the electrode 1 and the opposing electrode and then the toner particles 9 concentrated onto the ink meniscus 10 are ejected in a group from the meniscus 10 to the opposing electrode. The ejected toner particles 9 are resultantly fixed onto the recording media.

On the other hand, after the toner particles 9 are thus ejected, the number of toner particles 9 is reduced in the vicinity of the ink ejection slot 4 and there appear a large amount of counter ions having a polarity opposite to that of the toner particles 9 according to the quantity of electricity of the ejected toner particles. The counter ions exert an adverse influence onto the electric field created between the electrophoresis electrode 2 and the ejection electrodes 1 and prevents the toner particles from being supplied under the influence of the electrophoresis. Consequently, it is desired to remove the counter ions. In accordance with the embodiment, since the electrophoresis electrode 2 is applied with a bias voltage having a polarity equal to that of the toner particles 9, the generated counter ions move toward the electrophoresis electrode 2 due to the electrophoresis and proceeds up to an intermediate point of the ink discharge path having a high flow rate. Due to the pressure of the ink stream, the counter ions are rapidly removed from the neighborhood of the ink ejection slot 4 and then are brought into contact with the electrophoresis electrode 2 to be discharged as a result.

Furthermore, the toner particles 9 of the ink 3 supplied from the ink path 11 are subjected to an influence of the electric field associated with the electrophoresis electrode 2 when the toner particles 9 passes through a neighborhood of the ink ejection slot 4. Therefore, the toner particles 9 are continuously gathered in the area of the ink meniscus 10. In the configuration, since the electrophoresis electrode 2 is arranged along the ink supply route 11, while the ink 3 is flowing in the path 11, the toner particles 9 are gradually concentrated onto the side of the side wall under the influence of the electric field produced between the electrophoresis electrode 2 and the oposing electrodes.

In the toner particle supplying operation, when the ejection of toner particles 9 is interrupted for a short period of time for some reasons and an excessive amount of toner particles 9 are fed to the vicinity of the ink ejection slot 4, there may take place an disadvantageous event in which the toner particles 9 are ejected only due to the voltage applied to the electrophoresis electrodes. However, since the ink flows at a relatively low speed in the proximity of the ink ejection slot 4 because of the L-shaped route of the ink paths 11 and 12 and the ink flow rate is relatively increased in the central portion of the ink stream, a required amount of toner particles 9 is continuously supplied to the ink ejection slot 4 and the excessive toner particles 9 are fed in the high-speed ink stream. Resultantly, an appropriate amount of toner particles 9 is successively delivered to the ink ejection slot 4 in any situation.

As above, while the toner particles 9 are being supplied to the ink ejection slot 4, the printing operation is repeatedly accomplished, which leads to formation of a toner image on the recording media transported through the form feeding path. The recording media on which the toner image has been created is then carried to a fixing apparatus, not shown, similar to one used in an electrophotographic recording system so as to thermally fix the image on the recording media.

According to the embodiment, since only the toner particles 9 contained in the ink 3 are transported onto the recording media as above, it is possible to remove the drawbacks such as the blur conspicuously developed on the recording media in the printing operation using the conventional ink jet head in which the liquid ink is directly ejected from the head onto the printing media. This consequently leads to a high quality of printed characters which is equivalent to that obtained in the electrophotography.

Particularly, since the ink flow routes 11 and 12 are provided along the side wall of the ink ejection cell 6 and the ink ejection slot 4 is disposed in a portion of the side wall constituting the ink routes 11 and 12, the toner particles 9 can be swiftly fed from the ink stream to the ejection slot 4, thereby achieving a high-speed printing operation. Furthermore, the counter ions appearing after the toner particles 9 are thus ejected can be rapidly removed, the efficiency of the electric field can be preserved between the electrophoresis electrode 2 and the oposing electrodes. This consequently guarantees the supply of the required toner particles 9 to the ink ejection slot 4. This prevents a case in which the ejection of toner particles 9 is missing, which resultantly leads to a highly reliable printing operation.

In addition, the electrophoresis electrode 2 is disposed along the ink stream path 11 in a zone ranging from the upstream of the ink stream path 11 to the ink ejection slot 4. Therefore, while the toner particles 9 are being conveyed by the ink stream up to the ink ejection slot 4, the toner particles 9 are beforehand concentrated onto the side of the ejection slot 4, which advantageously guarantees the supply of toner particles 4 to the ejection slot 4.

Moreover, since the ink flow routes 11 and 12 have a bent portion in the proximity of the ink ejection slot 4, the required toner particles 9 can be sufficiently fed to the neighborhood of the ejection slot 4 at which the ink flow rate is relatively lowered. On the other hand, the toner particles 9 excessively fed up to the central part of the ink paths 11 and 12 are removed by the high-speed ink flow in the central part of the paths 11 and 12. This makes it possible to continuously supply an appropriate amount of toner particles 9 to the ink ejection slot 4, leading to advantages in the printing operation as follows. It is possible to prevent the case in which the toner particles 9 are not ejected due to an insufficient amount of supplied toner particles 9. The spontaneous ejection of toner particles 9 caused by an excessive supply of the toner particles 9 can be prevented. Moreover, an event in which the ejection slot is clogged up due to the excessive supply of toner particles can be also prevented. This resultantly increases the reliability in the printing operation.

Moreover, since the electrophoresis electrode 2 is provided in a zone ranging from the upstream to the downstream of the ink ejection slot 4, there can be formed an electric field to efficiently concentrate the toner particles 9 onto the ink ejection slot 4. Additionally, the counter ions taking place after the ink is ejected can be moved by electrophoresis onto the side of the electrophoresis electrode 2 in the flowing out or discharging process thereof. Namely, the counter ions can be swiftly removed from the ejection slot 4.

In particular, since the electrophoresis electrode 2 is arranged to be brought into contact with the ink 3 along an inner side of the ink stream paths 11 and 12, the counter ions can be brought into contact with the electrophoresis electrode 2 in the process of discharging the ink 3. Therefore, the counter ions can be removed by discharge in the ink jet head. Furthermore, since each ejection electrode 1 is coated with an insulation film, it is possible to prevent a disadvantageous event in which the toner particles 9 concentrated in the proximity of the ink ejection slot 4 fix onto the ejection electrodes 1 such that the ejection slot 4 is resultantly clogged up with the toner particles 9. This enables a stable printing operation in any situation.

Additionally, since the ink ejection slot 4 is subdivided into a plurality of partitions by the slit forming members 5, a plurality of ink meniscus can be produced in the single ink ejection slot 4. When the ejection electrodes 1 are arranged with a short distance therebetween, the recording resolution is increased and the recording head size is minimized. Moreover, since the plural ejection electrodes 1 can be operated at the same time for a simultaneous printing operation, the printing speed can be remarkably increased. As a result, the aspect of the rapid supply of the toner particles 9 can be fully utilized in the high-speed printing operation.

In this connection, the ink stream paths 11 and 12 need not be necessarily configured with the bent portion, but may be configured in a V shape or may be formed in a straight line. Furthermore, it is not necessary to fabricate the electrophoresis electrode 2 in an integral manner. Namely, the electrode 2 may includes a plurality of electrode sections in the upstream and/or downstream. In such a case, the electrophoresis electrodes 2 respectively of the upstream and downstream may be applied with mutually different bias voltages to adjust the formation of the electric field. It is not necessarily required that the electrophoresis electrode 2 is brought into contact with the ink 3 and along the ink flow routes 11 and 12.

In accordance with the present invention, the ink jet head is configured to serve functions as described above, namely, the ink stream paths are arranged along the side wall of the ink ejection cell and the ink ejection slot is disposed in a portion of the side wall constituting the ink stream paths. Therefore, the toner particles can be swiftly fed from the ink stream to the ink ejection slot to accomplish a high-speed printing operation. Additionally, since the counter ions appearing after the ejection of toner particles can be rapidly removed, the efficiency of the electric field created between the electrophoresis electrode and the oposing electrodes is guaranteed so that a required amount of toner particles are continuously supplied to the ink ejection slot. This prevents an event in which the ejection of toner particles is missing and accordingly leads to a highly reliable printing operation. Particularly, the ink chamber having a large capacity conventionally required becomes unnecessary and hence the size of the ink jet recording head can be remarkably minimized.

In accordance with the present invention, since the electrophoresis electrode is disposed in the zone ranging from the upstream of the ink stream path to the ink ejection slot and along the ink stream path, while the toner particles are being conveyed by the ink stream up to the ink ejection slot, the toner particles are beforehand concentrated onto the side of the ejection slot. This advantageously guarantees the toner particle supplying operation.

In accordance with the present invention, since the electrophoresis electrode is arranged to be brought into contact with the ink along an inner side of the ink stream paths, the counter ions can be brought into contact with the electrophoresis electrode in the process of discharging the ink, Therefore, the counter ions can be removed by electric discharge in the ink jet head. Additionally, since each ejection electrode is coated with an insulation film, it is possible to prevent a disadvantageous event in which the toner particles concentrated in the proximity of the ink ejection slot fix onto the ejection electrodes to resultantly clog the ejection slot. This enables a stable printing operation in any situation.

In accordance with the present invention, since the electrophoresis electrode is provided in a zone ranging from the upstream to the downstream of the ink ejection slot, an electric field is produced to efficiently concentrate the toner particles onto the ink ejection slot. Moreover, the counter ions appearing after the ink is ejected can be moved by electrophoresis onto the side of the electrophoresis electrode in the discharging process thereof. Resultantly, the counter ions can be removed from the ejection slot at a high speed.

In accordance with the present invention, the ink ejection slot is subdivided into a plurality of partitions by the slit forming members. Consequently, a plurality of ink meniscus are produced in the area of the single ink ejection slot. Arranging the ejection electrodes with a short distance therebetween, it is possible to increase the recording resolution and hence the recording head size can be minimized. In addition, since the plural ejection electrodes can be operated at the same time for a simultaneous printing operation, the printing speed is remarkably increased. Therefore, the aspect of the rapid supply of the toner particles can be fully taken advantage of in the high-speed printing operation.

In accordance with the present invention, since the ink stream paths include a curved portion in the proximity of the ink ejection slot, the required toner particles can be sufficiently fed to the neighborhood of the ejection slot at which the ink flow rate is relatively low. On the other hand, the excessive toner particles supplied up to the central part of the ink paths are removed by the high-speed ink flow in the central part thereof. Consequently, an appropriate amount of toner particles can be continuously fed to the ink ejection slot to resultantly obtain the following advantages in the printing operation. There can be prevented the case in which the toner particles are not ejected due to an insufficient amount of supplied toner particles. The spontaneous ejection of toner particles caused by an excessive supply of toner particles can be prevented. Moreover, an event in which the ejection slot is clogged up due to the excessive supply of toner particles can be also prevented, which accordingly increases the reliability of the printing operation. This makes it possible to provide an ink jet recording head having the novel advantageous features above.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An ink jet recording head, comprising:

an ejection cell body containing an ink including a plurality of toner particles, the ejection cell body having at least one side wall;

a slit-shaped ink ejection slot formed by an opening in a portion of the ejection cell body;

an ink stream path formed in the sidewall of the ejection cell body, the ink stream path defining a flow path for a stream of the ink from an upstream location to a downstream location, the ink stream path having an inner wall and an outer wall;

an electrophoresis electrode disposed along the ink stream path and located opposite the ejection slot for concentrating at least a portion of the toner particles onto the ink ejection slot; and an ejection electrode disposed in the ink ejection slot for imparting an ejection force to the toner particles; and the ink ejection slot being formed on a portion of the side wall of the ejection cell body along the outer wall of the ink stream path, so that the ink stream path extends from said upstream location to said downstream location, such that at least a portion of the toner particles in the ink stream flow in said ink stream path from said upstream location to said downstream location past said ink ejection slot.

2. An ink jet recording head accordance with claim 1, wherein the electrophoresis electrode is disposed from an upstream side of the ink stream path to the ink ejection slot.

3. An ink jet recording head in accordance with claim 1, wherein:

the electrophoresis electrode is disposed from an upstream side of the ink stream path to the ink ejection slot, disposed; and the ejection electrode is coated with an insulating film.

4. An ink jet recording head accordance with claim 1, wherein the electrophoresis electrode is disposed in from an upstream side to a downstream side of the ink ejection slot.

5. An ink jet recording head in accordance with claim 1, wherein the ink ejection slot is subdivided into a plurality of slit-shaped partitions by a plurality of slit forming members.

6. An ink jet recording head in accordance with claim 1, wherein the ink stream path includes a bent portion in a vicinity of the ink ejection slot.

7. An ink jet recording head in accordance with claim 1, wherein the electrophoresis electrode is disposed along the inner wall of the ink stream path.

* * * * *